United States Patent [19]

Hasegawa et al.

[11] 4,081,888

[45] Apr. 4, 1978

[54] APPARATUS FOR PRODUCING COMPACT YARN PACKAGE

[75] Inventors: Katsumi Hasegawa, Kusatsu; Toru Nakanishi, Otsu; Toshihiko Oka, Moriyama, all of Japan

[73] Assignee: Toray Industries, Inc., Tokyo, Japan

[21] Appl. No.: 780,690

[22] Filed: Mar. 23, 1977

[30] Foreign Application Priority Data

Mar. 26, 1976 Japan ..... 51-32415

[51] Int. Cl.[2] ..... B65H 54/84

[52] U.S. Cl. ..... 28/285; 28/289

[58] Field of Search ..... 28/284, 285, 286, 289, 28/254, 255, 118

[56] References Cited

U.S. PATENT DOCUMENTS

| | | | |
|---|---|---|---|
| 3,234,627 | 2/1966 | Russo et al. | 28/286 X |
| 3,425,110 | 2/1969 | Willis | 28/286 |
| 3,619,875 | 11/1971 | Gates | 28/286 X |
| 3,702,492 | 11/1972 | Pearce | 28/286 |
| 3,751,945 | 8/1973 | Eschenbach et al. | 28/286 X |

*Primary Examiner*—Louis K. Rimrodt
*Attorney, Agent, or Firm*—Miller & Prestia

[57] ABSTRACT

Disclosed is an apparatus for producing a compact package of a textile yarn, comprising an accumulation container disposed to a machine frame in a rotatable condition about a longitudinal axis thereof, an inlet of a textile yarn formed at a position above said accumulation container in an eccentric condition to said longitudinal axis of said accumulation container, a compression means provided with a pressing head capable of being inserted into said accumulation container. Said pressing head is capable of reciprocally displacing up and down along said longitudinal axis of said accumulation container in such a condition that the working position of said pressing head is eccentric from said longitudinal axis of said accumulation container.

16 Claims, 23 Drawing Figures

APPARATUS FOR PRODUCING COMPACT YARN PACKAGE

BACKGROUND OF THE INVENTION

The invention relates to an apparatus for producing a compact package of textile yarn without employing a bobbin-like supporting member.

In the conventional yarn package forming apparatus, a package of textile yarn is formed on a bobbin or bobbin-like member generally by means of winding machine. Recently, the processing speed of yarn is being increased to a level of 4,000 to 5,000 m/min or more. However, even if the processing speed of yarn is increased, if the size of the winding machine becomes larger or the precision of the winding machine is remarkably degraded in attempting to increase its speed, such winding machine can not be preferably adopted for practical use. Therefore, it becomes necessary to improve the operational capability of the winding machine so that the winding speed is increased to correspond to the increased yarn processing speed without affecting the quality of the yarn.

Japanese Patent Publication No. Sho-43(1968)-17639 discloses a method for accumulating a textile yarn in a receiving container of a certain shape without winding on a bobbin or bobbin-like member so that a yarn package is formed. In this prior art, the apparent specific gravity of the yarn package, is generally about 1/5 to 1/10 of the specific gravity of a conventional yarn package formed on a bobbin by means of winding machine. Thus, the size of the yarn package is so large that the yarn package is unsuitable for the subsequent processing or transportation thereof. In addition, the above-mentioned yarn package formed in a container has a further drawback in that, in the accumulated block of the yarn, portions of the yarn become entangled with each other and it is difficult to smoothly unwind the yarn from the yarn package because of yarn breakage and entanglement of yarn portions. Accordingly, the high speed operation of the yarn processing can not be carried out and the productivity of the machine is lowered very much.

In Japanese laid-open patent specification No. Sho--50(1970)-132235, it is disclosed that a predetermined quantity of textile yarn is accumulated in a receiving container and the accumulated block of yarn is then compressed under a pressure in a range between 20 and 200 kg/cm$^2$. However, in this case the accumulated block of yarn becomes bulky, in that the apparent specific gravity thereof is in a range between 0.02 and 0.1 g/cm$^3$. This is true even with the variation of the apparent specific gravity due to differences in the material fiber and configuration of yarns. Therefore, this prior art has the drawbacks that the accumulated yarn block is difficult to transport to the subsequent compression stage, the apparatus for the compression of the yarn block must be enlarged in size and the change in the volume of the yarn block before and after the compression stage is so large it is difficult to handle the yarn block under a constant operating condition.

BRIEF DESCRIPTION OF THE INVENTION

It is the primary object of the present invention to provide an apparatus for efficiently producing a compact package of high density from a textile yarn which is delivered at a high speed, which apparatus can eliminate the drawbacks of the above-mentioned prior arts.

Other objects and advantages of the present invention will become apparent from the following description.

The present invention provides an apparatus for producing a compact package of textile yarn comprising means for supplying the yarn to an accumulation container for receiving the ejected yarn and means for compressing the block of yarn accumulated in the container. In a preferable embodiment of the apparatus according to the apparatus of the present invention, the accumulation container is disposed rotatably about the vertical longitudinal axis of the container, an inlet for a yarn ejected with a high speed fluid from an ejection nozzle is provided on the upper end of the accumulation container eccentrically with respect to the longitudinal axis of the accumulation container and the compression means is provided with a pressing head disposed eccentrically with respect to the longitudinal axis of the accumulation container. The pressing head is capable of moving up and down in the inside of the accumulation container. Preferably the eccentric position of the inlet is at a position different from the eccentric position of the pressing head.

DETAILED DESCRIPTION OF THE INVENTION

Figure 1:
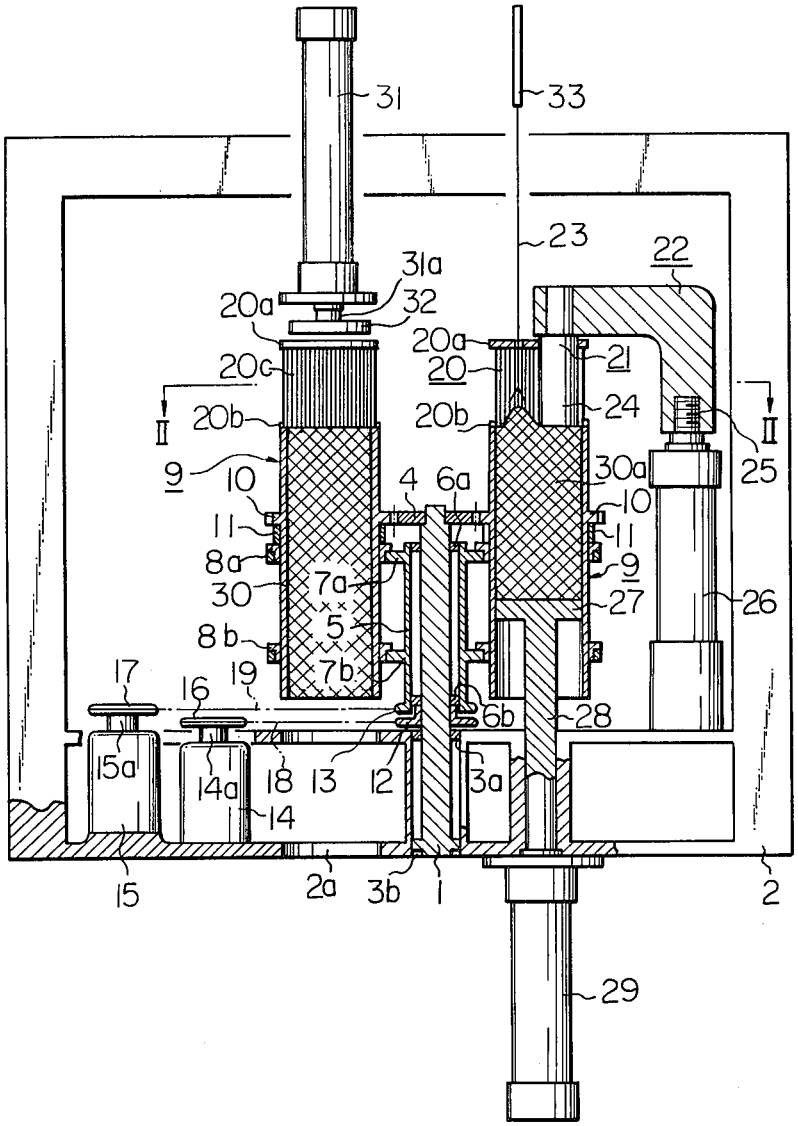
FIG. 1 is a side sectional view of an embodiment of the apparatus according to the invention.

The apparatus of the present invention will now be explained in detail, with reference to the accompanying drawings. Referring to FIG. 1, a shaft 1 is perpendicularly mounted on a machine frame 2 in a rotatable condition by means of a suitable bracket (not shown) and is provided with bearing means 3*a*, 3*b*. A gear 4 is secured to the top end portion of the shaft 1. A cylindrical body 5 is coaxially mounted on the shaft 1 by way of a pair of bearing means 6*a*, 6*b*. The cylindrical body 5 is provided with a pair of horizontal supporting arms 7a, 7b symmetrically extended outwards from the outside cylindrical wall thereof. A pair of accumulation containers 9 are rotatably supported by the horizontal supporting arms 7a, 7b, in a symmeterical relationship with respect to the longitudinal axis of the shaft 1, by way of a pair of supporting rings 8a, 8b. The rings 8a, 8b are rigidly mounted on the horizontal supporting arms 7a, 7b, respectively, in a symmetrical relationship with respect to the longitudinal axis of the shaft 1. Each accumulation container 9 is provided with a horizontal gear 10 which engages with the gear 4. To correctly position these accumulation containers 9, each container 9 is provided with a collar 11 at a position between the gear 10 and the ring 8a. The vertical shaft 1 is provided with a sprocket wheel 12 secured to a position adjacently below the cylindrical body 5, while the cylindrical body 5 is provided with a sprocket wheel 13 formed at the lower end thereof. Driving motors 14 and 15 are mounted on the machine frame 2 and these motors 14, 15 are provided with the corresponding sprocket wheels 16, 17, which are secured on the motor shafts 14a, 15a, respectively. The sprocket wheel 12 is driven by the motor 14 by way of the sprocket wheel 16 and an endless chain 18, while the sprocket wheel 13 is driven by the motor 15 by way of the sprocket wheel 17 and an endless chain 19.

In the above-mentioned construction, (hereinafter referred to as a turret mechanism) the driving motors 14 and 15 are driven alternately. That is, when the positions of the two accumulation containers 9 must be exchanged with each other, the motor 15 is driven while the driving motor 14 is stopped; on the other hand, when one of the accumulation containers 9 is utilized for receiving a yarn thereinto, the driving motor 15 is stopped and the driving motor 14 is driven so as to rotate the container 9 about the longitudinal axis thereof.

As mentioned above, each accumulation container 9 is disposed in a rotatable condition about the longitudinal axis thereof by the above-mentioned turret mechanism provided with the driving motor 14. In the above-mentioned driving mechanism, however, the rotation of the accumulation container 9 should be carried out intermittently so as to prevent any possible entanglement of yarn in the yarn package formed in the accumulation container 9. The reason for this requirement will be explained later.

The upper portion of the accumulation container 9 has a peripheral porous wall composed of, for example, a net-like material, or perforated or slitted plate, forming a separation chamber 20 having an inside diameter identical to that of the lower portion of the accumulation container 9. In this embodiment, the separation chamber 20 is composed of a pair of horizontal rings 20a and 20b and a plurality of rods 20c having a circular lateral cross section. The rods 20c are rigidly held by the rings 20a, 20b so as to form a peripheral wall having a plurality of vertical slits formed between two adjacent vertical rods 20C.

A compression means 21 is disposed on the machine frame 2 at a particular position where the accumulation container 9 receives a yarn 23 therein. At this particular position the compression means 21 is inserted perpendicularly into the separation chamber 20 and the compression means 21 is moved up and down by a crank arm 22. The crank arm 22 is mounted on a piston rod 25 of a pneumatic or hydraulic cylinder 26 mounted on the machine frame 2 in such a condition that the bottom terminal of the above-mentioned up and down motion of the pressing head 24 of the compression means 21 is capable of coming to a level below the bottom end of the separation chamber 20. The accumulation container 9 is provided with a bottom plate 27 which is capable of irreversibly displacing downward along the longitudinal axis of the container 9. The bottom plate 27 is rigidly mounted on a vertical rod 28 which is supported by a pneumatic or hydraulic cylinder 29.

As already explained, at a position opposite to the container 9 whith respect to the center of a turret mechanism, another accumulation container 9 is positioned. The supporting arms 7a, 7b can be rotated about the central axis of the turret mechanism by the driving motor 15 so that the empty container 9 is carried to the yarn package-taking off position, where the other container 9 has previously been positioned.

In this embodiment, when the yarn package forming operation is carried out, the bottom plate 27 is initially positioned at a position where it is capable of contacting the pressing head 24 at the same level as the ring 20b of the separation chamber 20. As the yarn package forming operation progresses the bottom plate 27 is gradually displaced downward in accordance with the growing of the mass of the yarn block formed on the bottom plate 27 in the accumulation container. During the above-mentioned operation, the yarn block formed in the container 9 is intermittently compressed by the movement of the pressing head 24 toward the bottom plate 27, which is always resistant to the downward movement of the pressing head 24. When it is necessary to move the pressing head 24 out of and away from the separation chamber 20, the piston rod 25 is stopped at its uppermost position where the bottom end of the pressing head 24 is positioned outside the separation chamber 20. On the other hand, when it is necessary to exchange the positions of two accumulation containers 9, the pneumatic or hydraulic cylinder 29 is actuated so as to move the bottom plate 27 out of the container 9, the pressing head 24 is also moved out of and away from the container 9 in the above-mentioned manner and, thereafter, the above-mentioned turret mechanism is actuated so as to exchange the positions of the two accumulation containers 9.

Figure 2:
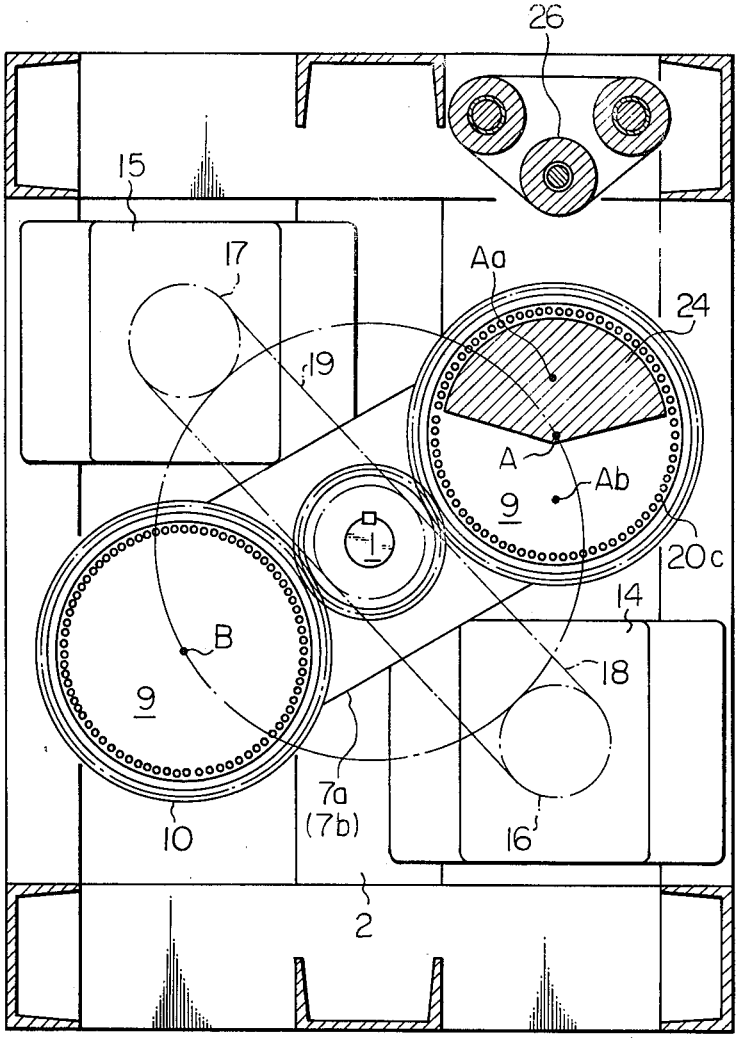
FIG. 2 is a cross-sectional view of the apparatus taken along the line II—II in FIG. 1.

In FIG. 2, the position for forming a yarn package in the accumulation container 9 is represented by a letter A, while the position for discharging a yarn package from the accumulation container 9 is represented by a letter B. The two accumulation containers 9 change their positions from A to B and B to A, respectively, at each turning motion of the turret mechanism shown in FIG. 1. Since such turret mechanism is well known in the art, an explanation of how to control the driving motion of the motor 15 and how to stop the displacing motion of the accumulation containers 9 so as to correctly position them at the corresponding working positions A, B, respectively, is omitted.

Referring to FIGS. 1 and 2, a mechanism for discharging a yarn package 30 formed in the accumulation container 9 at the position B will now be explained in detail. A pneumatic cylinder 31 is vertically disposed at a position right above the position B. A pushing head 32 is secured to a lower end of a piston rod 31a of the pneumatic cylinder 31 in such a condition that the pushing head 32 is capable of being inserted into the accumulation container 9 positioned at the position B. In this embodiment, the machine frame 2 is provided with an aperture 2*a* at a position right below the position B. The center of this aperture 2*a*, the accumulation container 9 positioned at the position B, the pneumatic cylinder 31 and the piston rod 31*a* are aligned along a common vertical line. The lateral space of the aperture 2*a* is large enough that the yarn package 30 does not contact the aperture 2*a* when it passes therethrough upon being discharged from the apparatus.

In the embodiment shown in FIG. 1, the yarn 23 is supplied from an ejection nozzle 33 together with a high speed air flow, such as jet air flow. The yarn 23 is accumulated in the container 9 in such a condition that the yarn 23 is firstly received by the bottom plate 27, and when a block 30*a* of the yarn 23 is formed on the bottom plate 27, the yarn 23 is deposited on the top layer of the block 30*a* of the yarn 23 formed on the bottom plate 27. Since the separation chamber 20 is provided with a plurality of vertical slits, the air introduced into the chamber 20 escapes escapted from the chamber 20, while the yarn 23 is received by the accumulation container 9. It is essential that the gauge of each slit must be designed in such a condition that the yarn 23 can not pass through these slits.

To create a compact yarn package in the accumulation container 9, the yarn 23 is deposited into the container 9 at a position which is eccentric with respect to the longitudinal axis (A in FIG. 2) of the container 9. A point A*b* in FIG. 2 represents the above-mentioned eccentric position. Further, the compression means 21 provided with the pressing head 24 presses the yarn block 30*a* as already explained. The working center of the pressing head 24 is represented by A*a* in FIG. 2, from which it can be understood that the position of the pressing head 24 is also eccentric from the longitudinal axis of the container 9. As shown in FIG. 2, the point A*b* must be designed so as to be outside the pressing head 24.

In the above-mentioned embodiment, it is preferable that the rotation of the container 9 be stopped during the time the compression means 21 presses the accumulated yarn block 30*a* in the container 9, so as to prevent possible entanglement of the yarn 23 during the yarn package forming operation. In such a case, during the time the rotation of the container 9 is stopped, the yarn 23 ejected from the ejection nozzle 33 is accumulated onto an area of the accumulation surface of the yarn block 30*a* which is not contacted by the pressing head 24 of the compression means 21. When the pressing head 24 is moved up, the container 9 is rotated to an angular position at which the pressing head 24 faces the top surface of the newly accumulated portion of the yarn block 30*a* and the yarn 23 is then accumulated onto the next surface portion of the yarn block 30*a*. When the rotation of the container 9 is stopped at the above-mentioned angular position, the pressing head 24 is moved down to press the above-mentioned newly accumulated portion of the yarn block 30*a*. Thus, undesirable friction between the accumulated yarn and the pressing head 24, which may damage the yarn 23, can be avoided. As mentioned above, when the rotation of the accumulation container 9 is stopped, the pressing head 24 is displaced downward so that the yarn block 30*a*, formed in such a condition that the apparent specific gravity is not very high, is pressed. Thus the above-mentioned up and down motion of the pressing head 24 is successively carried out in the above-mentioned relationship with the intermittent turning motion of the accumulated container 9.

Figure 3A:
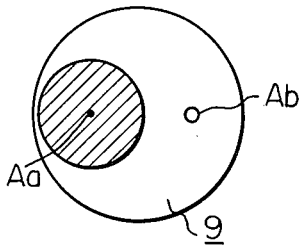
FIGS. 3A and 3B are plan views showing related positions of the pressing head of the compression means, the accumulation container and the inlet for the textile yarn, wherein two types of pressing heads are shown.
Figure 3B:
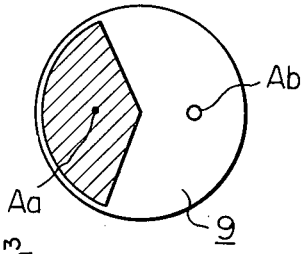

To effectively carry out the pressing action by the compression means 21 applied to the yarn block 30*a*, the pressing head 24 is provided with a particular construction, which will now be explained in detail. In FIGS. 3A and 3B, there are shown examples of the related disposition of the pressing head 24 of the compression means 21, the accumulation container 9 and the inlet for the textile yarn 23. The pressing head 24 of the compression means 21 shown in FIG. 3A has a circular lateral cross-section and the pressing head 24 shown in FIG. 3B has a sector shaped cross-section. In the embodiment shown in FIGS. 1 and 2, the latter type of the pressing head 24 is utilized. As shown in FIG. 2, the position A*a*, which corresponds to the center of the pressing head 24 of the compression means 21, and the position A*b*, which corresponds to the center of the yarn passage into the container 9, are arranged preferably at respective positions symmetrical with respect to the longitudinal axis of the accumulation container 9. The width of the pressing head 24 of the compression means 21 in the direction of a line connecting the position A*a* and the position A*b* is larger than the radius of the accumulation container. If the above-mentioned position A*b* is fixed at the middle between a position corresponding to the longitudinal axis of the accumulation container 9 and the inner periphery of the container 9, the accumulation of the yarn 23 is most desirably performed.

Figure 5:
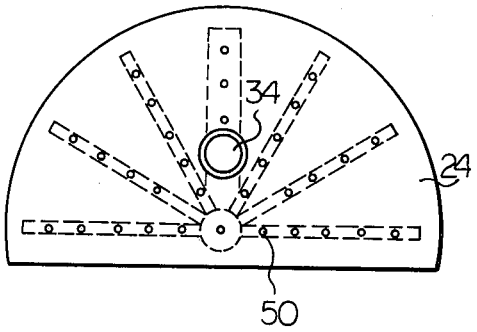
FIG. 5 is a bottom view of the pressing head of the compression means as shown in FIGS. 4A to 4E, showing the arrangement of apertures for ejecting heated fluid.
Figure 4A:
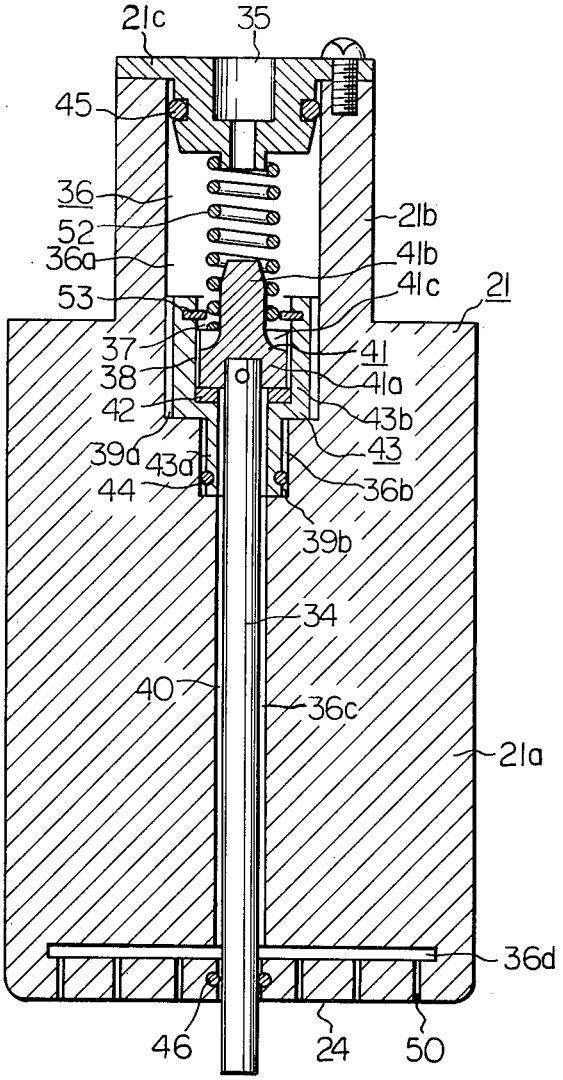
FIGS. 4A to 4E are sectional views showing the construction of a compression means adopted to the apparatus according to the invention.
Figure 4B:
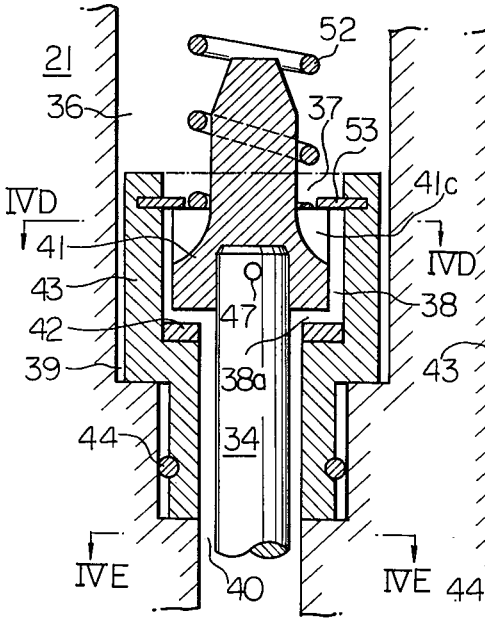
Figure 4C:
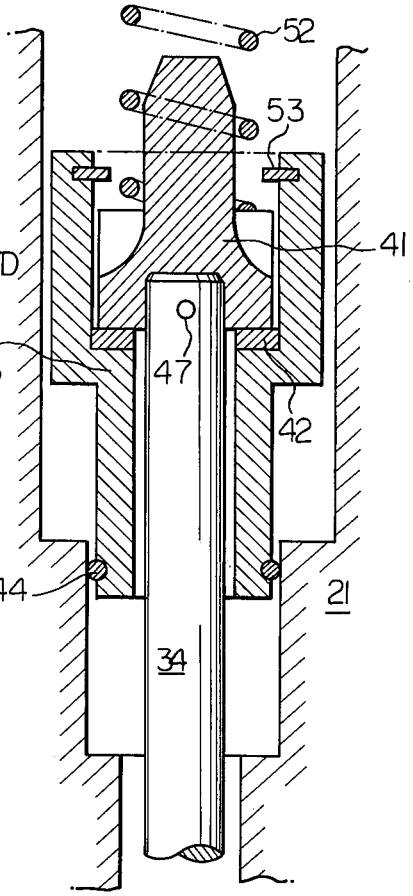
Figure 4D:
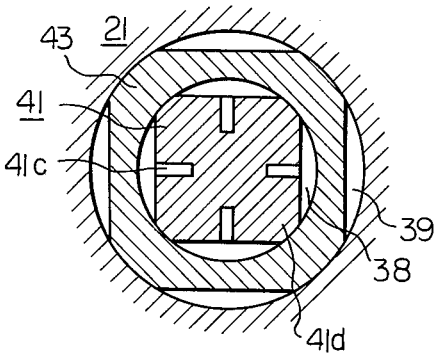
Figure 4E:
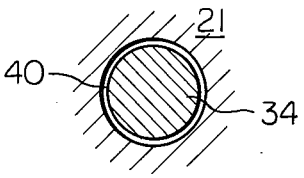

FIGS. 4A, 4B and 4C are sectional views of the inside construction of the compression means 21 taken along the longitudinal direction thereof, and FIGS. 4D and 4E are the same type views taken along the lateral direction thereof. As shown in FIG. 4A, compressing means 21 is provided with a main body portion 21*a* and a head portion 21*b* projected upward from the top of the main body portion 21*a*. The main body portion 21*a* and the head portion 21*b* are provided with a central hollow space 36, which comprises a narrow longitudinal space 36*c* and a laterally expanded space 36*a* as shown in FIG. 4A. A cover plate 21*c* is secured to the head portion 21*b* in such a way that the space 36 is closed. The cover plate 21*c* is provided with an aperture 35, which is utilized as an inlet of steam, passing therethrough along the longitudinal axis thereof, and the bottom projected portion thereof is inserted into the space 36*a*. The space 36*a* is provided with a laterally shrunken portion 36*b* formed at the bottom portion thereof. As shown in FIG. 4A, the aperture 35 and spaces 36*a*, 36*b* and 36*c* are aligned along the longitudinal axis of the commpression means 21. The main body portion 21*a* of the compression means 21 is also provided with a laterally expanded slit 36*d* in a lower portion thereof. The slit 36*d* is formed in such a manner that the space 36*c* is connected to the slit 36*d*, and a plurality of small apertures 50 are formed in this lower portion of the main body portion 21*a* in such a manner that the apertures 50 connect the slit 36*d* to the outside of the main body 21*a*. These apertures 50 are ejection apertures for permitting the discharge of steam therefrom and are arranged radially as shown in FIG. 5. A cylindrical body 43, which comprises a smaller cylindrical portion 43*a* and a larger cylindrical portion 43*b*, is disposed in the space 36 in such a condition that a shoulder formed between the portions 43*a* and 43*b* is capable of resting on a shoulder of the main body portion 21*a* formed between the spaces 36*a* and 36*b*. A detecting bar 34 is disposed in the spaces 36 in such a condition that the top portion thereof is freely inserted into a space 38 formed in the larger cylindrical portion 43b. A ring shaped packing 42 is mounted on the inside shoulder formed between the portions 43a and 43b in such a condition that the top portion of the detecting bar 34 is capable of freely passing through the packing 42. A valve 41, comprising a bottom portion 41a expanded laterally and a top portion 41b, is formed in such a manner that the bottom portion 41a is capable of resting on the packing 42. This bottom portion 41a is provided with a recess formed at a central bottom surface thereof, as shown in FIGS. 4A, 4B and 4C, so that the top of the detecting bar 34 is capable of being inserted into this recess. The valve 41 is secured to the top portion of the detecting bar 34 by a pin 47. The valve 41 has a square lateral cross-section and is further provided with four recesses 41c formed at the upper shoulder portion 41d thereof. A ring shaped packing 53 is rigidly disposed to an inside cylindrical wall of the larger cylindrical portion 43b of the cylindrical body 43 in such a condition that the above-mentioned shoulder portion 41d contacts the packing 53 when the valve 41 is displaced upward. A helical spring 52 is disposed in the space 36a in such a condition that the top end thereof is mounted on the bottom projected portion of the cover plate 21c and the bottom end thereof is mounted on the top portion 41b of the valve 41. Since the spring 52 is a spring provided with expansion capacity, the valve 41 is always urged downward by this spring 52. As is clearly shown in FIGS. 4A, 4B and 4C, a cylindrical space 38 is formed between the cylindrical body 43 and the valve 41, while cylindrical spaces 39a and 39b are formed between the cylindrical body 43 and the body of the compression means 21. A long cylindrical space 40 is formed between the inside wall of the space 36c formed in the main body 21a and the detecting rod 34, and also between the inside wall of the smaller cylindrical portion 43a and the detecting rod 34. A pair of O-rings 45 and 46 are mounted on the compression means 21, as shown in FIG. 4A, so as to prevent the escape of the steam to the outside thereof.

FIG. 4A shows the condition wherein the valve 41 is closed before the pressing operation. FIG. 4B shows the condition wherein the valve 41 is opened during the pressing operation. FIG. 4C shows the condition wherein the valve 41 is again closed after the pressing operation. FIG. 4D is a cross-sectional view along the line IVD—IVD in FIG. 4B and FIG. 4E is a cross-sectional view along the line IVE—IVE in FIG. 4B.

The operation of the compression means 21 shown in FIGS. 1, 2, 4A, 4B, 4C, 4D, 4E and 5 will now be explained in detail. At the position A, the bottom plate 27 is set at the level of the lower end of the separation chamber 20 of the accumulation container 9. Then, a textile yarn 23 is ejected from an ejection nozzle 33 together with compressed air. Thus, the textile yarn 23 is passed through the separation chamber 20 and accumulated on the bottom plate 27 in the container 9, while the air escaped through the slits of the separation chamber 20. During this accumulation operation, the rotation of the container 9 about the longitudinal axis thereof is started. At the time of the starting of the rotation of the container 9, the up and down movement of the compression means 21 is started.

When the compression means 21 is moved down and the lower end of the detecting bar 34 contacts the accumulation surface of the yarn block 30a formed onto the bottom plate 27, the detecting bar 34 is pushed into the inside of the compression means 21. Accordingly, in the inside of the compression means 21, the valve 41 is displaced upward relative to the cylindrical body 43 so that a cylindrical space 38a is formed between the bottom shoulder of the valve 41 and the packing 42 is shown in FIG. 4B. Therefore, the steam is capable of passing through the space 38a. Thus the steam flows into the accumulated yarn block 30a via the steam space 38 formed between the valve 41 and the cylindrical body 43, the long cylindrical space 40 and the plurality of apertures 50 radially formed in the pressing head 24.

When the compression means 21 is further moved down, the detecting bar 34 lifts up the valve 41 relative to the body of the compression means 21. Since the cylindrical body 43 is provided with the inwardly projected packing 53 at a position above the shoulder 41c of the valve 41, the shoulder 41c contacts the inwardly projected packing 53 so that the packing 53 is also displaced upward by the above-mentioned further lifting motion of the bar 34. Therefore the steam is continuously supplied to the yarn block 30a during the above-mentioned further downward motion of the compression means 21.

In the condition of the compression means 21 shown in FIG. 4B, the O-ring 44 maintain the position of the cylindrical body 43 in the space 36. Then, upon the completion of the pressing operation, the compression means 21 is moved up and the pressing head 24 leaves the surface of the yarn block 30a. At the same time, the valve 41 is pushed downward by the expansion force of the compressed spring 52, and therefore, the bottom end of the valve 41 contacts the packing 42 and the steam ejection from the pressing head 24 is stopped. When the compression means 21 is further moved up, the valve 41 is further pushed by the compressed spring 52 and, thus, the cylindrical body 43 is also pushed down together with the packing 42 so that the compression means 21 is again placed under the condition as shown in FIG. 4A. At the relative positions of the valve 41 and the cylindrical body 43 of the body of the compression means 21 shown in FIG. 4A, the connection between the cylindrical space 39a and the space 39b is interrupted by the contact of the shoulder formed between the smaller cylindrical portion 43a and the larger cylindrical portion 43b with the upper shoulder of the main body 21a formed between the space 36 and the space 36b. Further, the connection between the space 39b and the space 40 is also interrupted by the contact of the above-mentioned upper shoulder of the main body 21a with the bottom end of the cylindrical body 43. Therefore, ejection of the steam from the pressing head 24 is completely stopped.

While the above-mentioned operation is repeated, the textile yarn 23 accumulated on the bottom plate 27 is continuously increased and the bottom plate 27 connected to the piston rod 28 is successively displaced downward. When the container 9 is filled with textile yarn, the ejection of the textile yarn 23 from the nozzle 33, the rotation of the container 9 and the up and down movement of the compression means 21 are stopped, and the compression means 21 is pulled out from the separation chamber 20. At the same time, the bottom plate 27 is removed from the container 9. Thereafter, the turret mechanism is operated by means of the driving motor 15 so as to displace the container 9 previously positioned at the position A to the position B and the empty container 9 previously positioned at the position B to the position A. Thereafter the above-mentioned accumulation operation is carried out with respect to the empty container 9.

Figure 6:
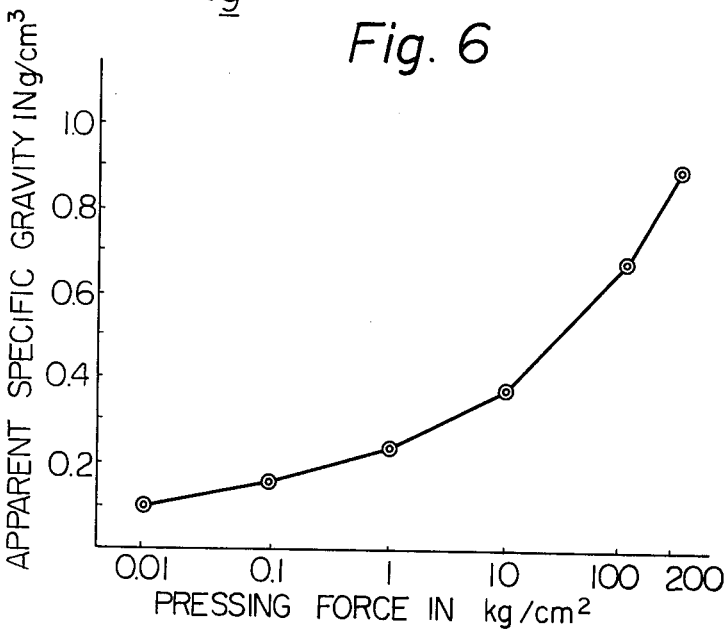
FIG. 6 is a graph showing the relation between the pressing force imparted to the accumulated yarn by the compression means and the apparent specific gravity of the yarn package produced.

In FIG. 6, there is shown a graph of the relationship between the pressing force imparted to an accumulated yarn block 30*a* by the compression means 21 and the apparent specific gravity of a yarn package 30 which has been formed on the apparatus shown in FIG. 1 by employing a polyester multifilament yarn of 150 denier/48 filaments. As is seen from this graph, according to the apparatus of the present invention, a yarn package 30 of desirable apparent specific gravity can be obtained by varying the pressing force created by the compression means.

For the experimental text upon which the data in FIG. 6 are based, six yarn packages 30 having a size of 150 mm(diameter) × 400 mm(axial length) and a weight of 470 g(in dried condition) were produced, and these yarn packages 30 were transferred into cylindrical containers each having an inside diameter of 150 mm. Thereafter, one of the yarn packages 30 was compressed from the two free ends thereof by means of a piston of an oil cylinder under a compression force as 0.1 kg/cm$^2$. The lateral diameter of this piston was 146 mm. Under the above-mentioned condition the axial length (L) of the compressed yarn package 30 was measured from the displacement distance of the piston. In this test, the displacement speed of the piston was controlled to be 10 cm/min. At the position where the piston was stopped, the compression of the yarn package 30 was maintained for one minute and then the above-mentioned axial length of the yarn package 30 was measured. Similar procedures were followed for the remaining five yarn packages except that the pressure conditions were 0.01, 1, 10, 100 and 200 kg/cm$^2$, respectively. The apparent specific gravity (g/cm$^2$) ASG was calculated from the following equation.

ASG = (weight of the yarn package in g) / [(the lateral cross-sectional area of the container for testing in cm$^2$) × (L in cm)].

In the above-mentioned embodiment, the bottom plate 27 is capable of displacing upward or downward, however, a bottom plate disposed stationary in the container 9 or a bottom plate detachably disposed in the container 9 may be utilized.

Concerning the adjustment of the pressure of the compression means 21, a pressure detector may be mounted on the bottom plate 27 of the container 9 so as to continuously carry out the yarn package forming operation until the desired density of the yarn package 30 can be created.

To prevent the undesirable recovery of the bulkiness of the yarn package 30, in the above-mentioned embodiment of the present invention, steam is applied to the yarn block 30*a* during the time the block 30*a* is compressed by the pressing head 24, by utilizing a special control valve 41 which permits the supply of steam into the yarn block 30*a* only at the time the block is being compressed.

From experimental tests which were conducted, it was found that if the inside wall of the container 9 is provided with a suitable resistance to the upward movement of the yarn block 30*a* in the container, it assists in overcoming possible recovery of bulkiness of the yarn package 30 after the pressing head 24 is displaced upward. One example of this type of container 9 is hereinafter explained with reference to FIGS. 7A to 7F, wherein a part of the cross-sectional view of the container 9 is shown.

Figure 7A:
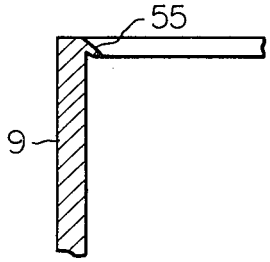
FIGS. 7A to 7F are schematic views of various types of anti-slip means provided on the inside wall of the accumulation container.
Figure 7B:
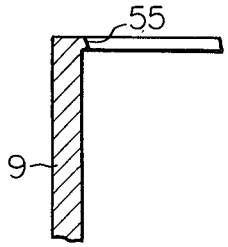
Figure 7C:
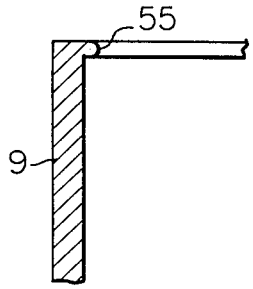
Figure 7D:
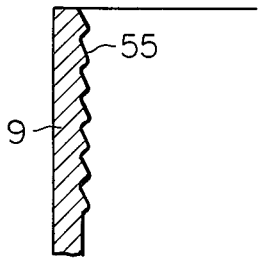
Figure 7E:
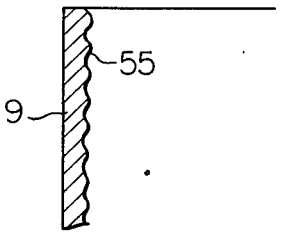
Figure 7F:
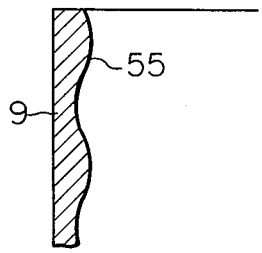

In FIGS. 7A to 7F, there are shown examples of anti-slip walls 55 consisting of convex projections and concave-convex surfaces. The anti-slip wall 55 may be designed so as to produce various frictional resistance. Too sharp convex projections may damage the yarn and too deep concave recesses may injure the outside surface of the yarn package 30 so that the smooth taking-up operation of the yarn therefrom can not be expected. The above-mentioned antic slip element may be formed only on the upper end of the inside wall of the container 9 as shown in FIG. 7A to 7C; or a waved surface may be formed over a certain extent of the upper portion of the inside wall of the container 9 as shown in FIG. 7D, or the waved surface may be formed over the entire area of the inside wall of the container 9 as shown in FIGS. 7E and 7F.

The hereinbefore mentioned pressing and heat treatment by steam is very advantageous in eliminating the disorder of the accumulation surface of the yarn block 30*a* in the container 9. The adoption of the anti-slip element 55 on the inner wall of the accumulation container 9 also advantageously prevents the creation of undesirable uneveness of the accumulation surface.

Therefore, it is preferable to utilize an accumulation container 9 as mentioned above in the embodiment shown in FIGS. 1 and 2, so as to create a more compact yarn package 30 in comparison with that created when a container having smooth inside walls is utilized. If an accumulation container as mentioned above is utilized, it is possible to produce a yarn package of large weight using an accumulation container of small size. For example, if an accumulation container of 150 mm diameter and 500 mm length is used, a yarn package of about 3 kg can be effectively produced. Contrary to this, if neither the steam is imparted into the yarn block during the compression by the pressing head 24 nor the anti-slip element is used, it becomes necessary to use an accumulation container 9 of 150 mm diameter and 2000 mm length for the production of a yarn package of the same weight. Obviously a yarn package with the latter dimensions is hard to handle in the subsequent yarn treatment stage.

Figure 8A:
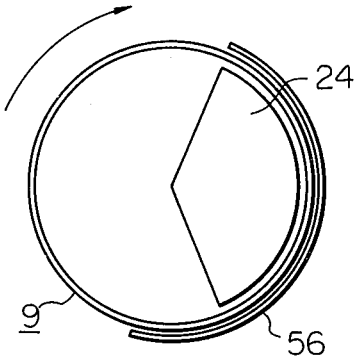
FIGS. 8A to 8D are plan views of the accumulation container wherein a masking shield is provided on the peripheral wall of the separation chamber of the accumulation container at the position facing to the pressing head of the compression means.
Figure 8B:
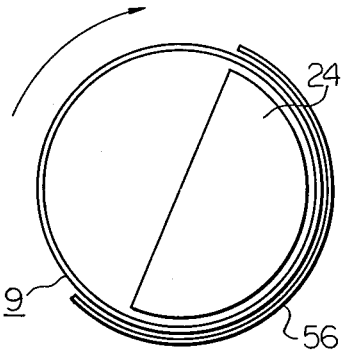
Figure 8C:
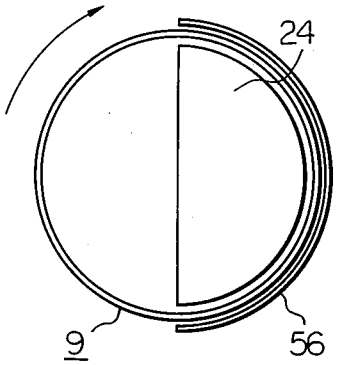
Figure 8D:
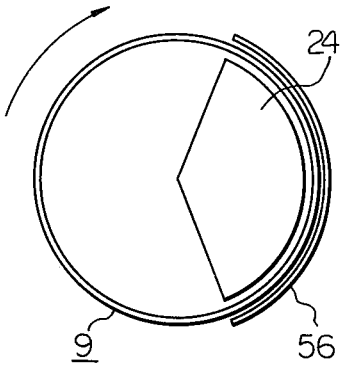

In the accumulation operation by the apparatus of the present invention, under the condition that the compression means 21 is moved up, the compressed air ejected together with the yarn 23 often creates a turbulent flow below the pressing head 24 of the compression means 21. This can result in the accumulation order of the yarn 23 on the upper surface of the yarn block 30*a* previously form in the container 9 becoming disordered. If the compression means 21 is positioned far from the accumulation surface to prevent the occurence of such turbulent flow of the compressed air, it is necessary to use a large size accumulation container 9 or to apply large stroke of the crank means 22. On the other hand, if the compression means 21 is positioned in close proximity to the accumulation surface of the yarn block 30*a*, the upper yarn layer of the yarn block 30*a* is possibly injured by the frictional contact of the pressing head 24 with the upper surface of the yarn block 30*a*. From experimental tests which were conducted, it was found that if a masking shield 56 is disposed at a position adjacently outside the peripheral wall of the separation chamber 20 of the accumulation container 9 in such a condition that the masking shield 56 faces the pressing head 24 of the compression means 21, the creation of the turbulent flow of the compressed air can effectively prevented and, thus, the above-mentioned problems can be avoided. In FIGS. 8A to 8D, there are shown examples of the masking shield 56 and the positions of the masking shield 56 and the pressing head 24 of the compression means 21. Practically, it is advantageous that the masking shield 56 be designed so as to seal the entire area of the portion of the wall slits facing the pressing head 24 of the compression means 21 as shown in FIGS. 8C and 8D, or seal an area slightly larger than that of the portion of the wall slits facing the pressing head 24 as shown in FIGS. 8A and 8B. The above-mentioned masking shield 56 is particularly advantageous in a case where the compression means 21 provided with the pressing head 24 is capable of ejecting heated fluid therefrom toward the yarn block 30*a* during the pressing operation.

Figure 9:
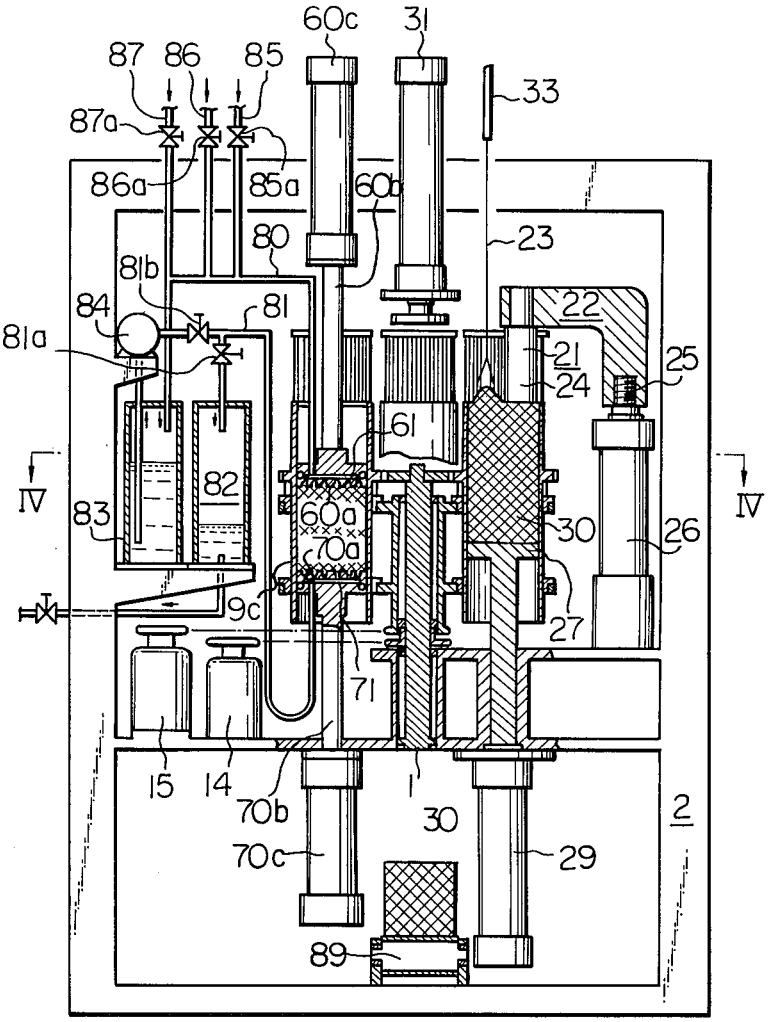
FIG. 9 is a side sectional view of another embodiment of the apparatus according to the present invention.
Figure 10:
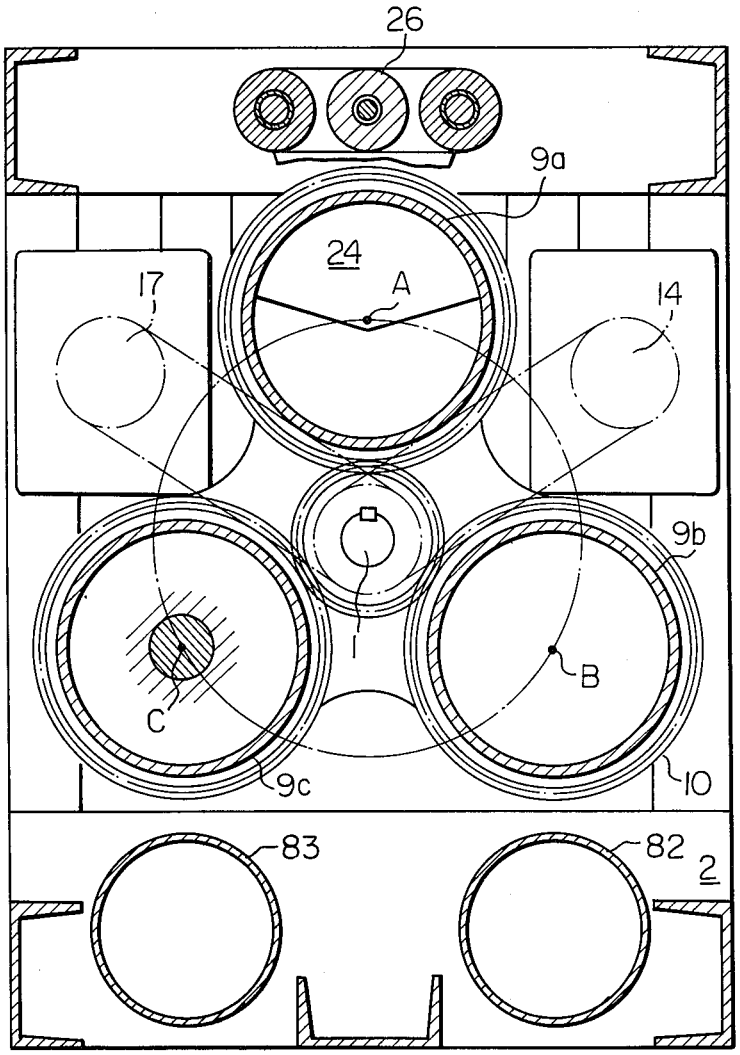
FIG. 10 is a cross-sectional view of the apparatus taken along the line IV—IV in FIG. 9.

A modified embodiment of the apparatus according to the present invention is hereinafter explained in detail with reference to FIGS. 9 and 10. In this embodiment, the yarn block 30*a* accumulated in the accumulation container 9 is subjected to an additional heat-set treatment, before being doffed from this apparatus. That is, in this embodiment, the accumulation container 9 is traveled on three positions at which a textile yarn is accumulated to form a yarn package 30, the accumulated yarn package 30 is compressed under a heated condition and, then, the yarn package 30 is taken off, successively. Thus, as shown in FIG. 10, three containers 9*a*, 9*b* and 9*c* are simultaneously utilized, and these containers 9*a*, 9*c*, 9*b* are positioned at respective positions A, C and B, arranged on an identical circle which has a center which coincides with the central axis of the turret mechanism. Since the turret mechanism, the mechanism for receiving the yarn 23 ejected from the nozzle 33 and the mechanism for discharging a yarn package 30 from the apparatus, are substantially the same as those of the first embodiment described hereinbefore, this explanation is only directed to the mechanism added to the first embodiment.

In this embodiment, an additional mechanism for heat-setting the yarn package 30 formed in the container 9*a* at the position A is utilized. That is, at the position C, there is provided a pair of piston heads 60*a*, 70*a* in facing condition to each other. These piston heads 60*a*, 70*a* are rigidly supported by the respective piston rods 60*b*, 70*b* of the corresponding pneumatic or hydraulic cylinders 60*c*, 70*c*. The longitudinal axes of these cylinders 60*c*, 70*c* are arranged along a common vertical line which passes the point C (FIG. 10). The lateral area or cross-section of the piston heads 60*a*, 70*a* is so designed that the piston heads 60*a*, 70*a* are a little smaller in size than the inside cross-sectional area of the accumulation container 9*a*, 9*b* and 9*c*. Each of the piston heads 60*a*, 70*a* is provided with a lateral slit 61, 71, respectively, and the lateral slit 61, 71 is connected to the free end surface of the piston head by way of a plurality of apertures, similar to the pressing head 24 of the compression means 21 of the first embodiment. The lateral slit 61 of the piston head 60*a* is also connected to a flexible conduit 80, a part of which is arranged close to the piston rod 60*b*. The piston head 70*a* is connected to a flexible conduit 81, a part of which is arranged close to the piston rod 70*b*. A pair of tanks 82 and 83 are mounted on the machine frame 2. Three supply conduits 85, 86 and 87 are disposed in such a condition that these conduits 85, 86 and 87 are connected to the conduit 80, and the conduit 87 is also connected to the tank 83. The conduit 81 is connected to the tank 82 by way of a control valve 81*a* and also connected to the tank 83 by way of a pump 84 and a control valve 81*b* as shown in FIG. 9. At the inlet portion of the conduits 85, 86 and 87, there are provided respective control valves 85*a*, 86*a* and 87*a*. With the above-mentioned construction, the additional operation by this mechanism is carried out as follows. At the working position C, the pneumatic or hydraulic cylinders 60*c*, 70*c* are actuated so as to displace the respective piston heads 60*a*, 70*a* into the accumulation container 9*c* positioned at the position C. Since a yarn package 30 is positioned in this container 9*c*, the yarn package 30 is further compressed by the above-mentioned motion of the piston heads 60*a* and 70*a*. When the yarn package is compressed to a predetermined pressure, the compression operation by the piston heads 60*a* and 70*a* is stopped and heated fluid is injected into the yarn package through fluid supply apertures of the piston head 60*a*. This heated fluid is supplied from the conduit 85. The fluid passed through the layer of the yarn package, is delivered through fluid delivery aperture formed on the piston head 70*a* and is discharged into the tank 82. At the periphery of each of the piston heads 60*a*, 70*a*, O-rings are mounted so as to prevent the run-off of the fluid to the outside of the container. After the lapse of a predetermined amount of time, the injection of the heated fluid is stopped and compressed air is then supplied into the yarn package through the air supply conduit 86 and the conduit 80, and through the aperture of the piston head 60*a*. The compressed air is delivered to the tank 82 in the same way as the heated fluid so that the heated fluid retained in the yarn package can be pushed out. When the retained heated fluid is pushed out completely by the compressed air, the supply of the compressed air is stopped. Thus, the compression and heat treatment of the yarn package formed in the container 9*c* at the position A is completed.

If required or preferable, an oiling agent may then be applied to the yarn package. This oiling treatment can also be carried out also at this position C in the following manner. When the feeding of the compressed air is stopped by closing the valve 86*a*, an oiling agent from an oiling agent stock tank 83 is supplied into the yarn package in the container 9*c* positioned at the above-mentioned position C, by way of the apertures of the piston head 70*a* by operating a pump 84 provided on the oiling agent feeding line. The oiling agent is then passed through the layer of yarn package, delivered through the apertures of the piston head 60*a* and recovered into the oiling agent stock tank 83. The recovered oiling agent is again fed into the container 9*c* through the pump 84. After the circulation of the oiling agent for a predetermined period of time, the operation of the pump 84 is stopped. Again, the compressed air is supplied into the yarn package from the apertures of the piston head 60*a* to push out the retained oiling agent solution into the tank 83. Then, the feeding of the compressed air is stopped. When the heat treatment or oiling treatment is completed as mentioned above, the piston heads 60*a* and 70*a* are returned to their original standby positions.

On the other hand, at the position B, the piston means 31 is operated with respect to the container 9*b* which has been displaced from the previous position C to this position. Thus, the yarn package 30 in the container 9*b* is pushed downward by the piston means 31 and taken out from the lower end opening of the container 9*b* and received by a receiving plate 89.

After a while, when the accumulation operation with respect to the container 9a at the position A is completed, the turret mechanism is again operated to displace the containers 9a, 9c and 9b to the positions C, B and A, respectively, and at the respective positions, the above-mentioned operations are repeated. Thus, the accumulation of the textile yarn for forming the yarn package and the subsequent treatments of the yarn package are continuously carried out. In this second embodiment, if desired, the container positioned at the position A may be displaced directly to the position B and at this position the yarn block may be taken out from the container by pressing through the piston means 31.

The yarn package thus formed may be covered with a wrapping sheet or handled without being covered.

Even if the bottom plate 27 is removed at the time of the rotation of the turret mechanism after the completion of the accumulation operation, the yarn package 30 does not fall from the container due to the pull of gravity, because frictional force is exerted between the inside wall surface of the container 9 and the periphery of the yarn package 30.

The piston means 29 for supporting the bottom plate 27 may comprise a pressure control mechanism which can balance the pressing force of the piston means 29 and the pressing force of the compression means 21.

The turret mechanism utilized in the first and second embodiments of the invention may be omitted. In such a case, when the accumulation operation is completed by the accumulation mechanism, the container filled with the accumulated yarn block may be manually exchanged for a fresh container. Then, the accumulation operation is carried out with respect to the fresh container. On the other hand, the bottom plate 27 may be fixedly mounted on the container. In such a case, the up and down movement of the compression means may be started at the time when the yarn is accumulated up to a level of the upper end of the accumulation container. It is also applicable that the bottom plate 27 is removably mounted because the formed yarn block can easily be taken out by removing the bottom plate after the completion of the accumulation operation. In the embodiment mentioned above, the textile yarn to be accumulated in the container is ejected together with compressed air, however, the present invention is not limited to only such a case. Thus, the yarn may be fed by other delivery means such as a delivery roller or a conveyor. In such a case, the separation chamber for separating the compressed air from the yarn can be omitted.

The apparatus of the present invention has the following advantages in the production of a compact yarn package.

A. textile yarn, even if the yarn is fed at a very high speed, can be easily accumulated by a simple operation and the apparatus does not necessitate any high speed rotating members.

B. Yarn packages of desired density can be produced depending upon the characteristics of the yarn to be processed or the characteristics required for the subsequent yarn processing stages.

C. The take-up operation of the yarn from the resulting yarn package can be carried out smoothly with very high working efficiency.

D. The size of the apparatus can be compact because the yarn can be formed in a very compact condition even at the initial stage of the package formation.

E. Yarn packages can be produced in one stage from a texile yarn fed at a very high speed.

F. It is easy to automate and yarn treatment process because the formed yarn package can be automatically and continuously taken out.

G. Large storage space is not necessary because the formed yarn packages are compact.

What is claimed is:

1. An apparatus for producing a compact package of a textile yarn, comprising an accumulation container disposed to a machine frame in a rotatable condition about a longitudinal axis thereof, an inlet of a textile yarn formed a position above said accumulation container in an eccentric condition to said longitudinal axis of said accumulation container, a compression means provided with a pressing head capable of being insered into said accumulation container, said pressing head being capable of reciprocally displacing up and down along said longitudinal axis of said accumulation container in such a condition that the working position of said pressing head is eccentric from said longitudinal axis of said accumulation container.

2. An apparatus for producing a compact package of a textile yarn according to claim 1, wherein said compression means is provided with a heated fluid supply aperture opened at a bottom surface of said pressing head.

3. An apparatus for producing a compact package of a textile yarn according to claim 1, wherein said eccentric position of said inlet is biased from said eccentric position of said pressing head with respect to said longitudinal axis of said accumulation container.

4. An apparatus for producing a compact package of a textile yarn according to claim 1, wherein said inlet of yarn is defined by a fluid jet nozzle from which a yarn is ejected therefrom together with a high speed air flow.

5. An apparatus for producing a compact package of a textile yarn according to claim 1, wherein said accumulation container is provided with a bottom plate which is displaceably disposed therein.

6. An apparatus for producing a compact package of a textile yarn according to claim 1, wherein a pair of said accumulation containers are utilized in such a condition that these accumulation containers alternately change their positions from a position for accumulating said yarn into said container to a position for discharging a yarn package from said accumulation container and vise versa.

7. An apparatus for producing a compact package of a textile yarn according to claim 6, wherein said accumulation containers are mounted on a turret in a symmetrical relationship with respect to a turning center of said turret.

8. An apparatus for producing a compact package of a textile yarn according to claim 6, wherein, at a position for discharging a yarn package from said accumulation container, a mechanism for discharging a yarn package from said accumulation container is disposed at a position above said accumulation container positioned at said discharging position.

9. An apparatus for producing a compact package of a textile yarn according to claim 1, wherein three of said accumulation containers are utilized in such a condition that these accumulation containers are positioned at three different working positions of said apparatus respectively when one of said containers is utilized for forming a yarn package therein, one of said working position is a position for forming said yarn package in one of said containers, the other two working positions are a position for carrying out an additional operation to said yarn package previously formed in one of said containers and a position for discharging said yarn package from one of said containers, each of said three containers is capable of stepwisely displacing from one of said working positions to the next one of said working positions and, further, to the next one of said working positions, in such a condition that said stepwisely displacement of each of said containers is continuously carried out simultaneously.

10. An apparatus for producing a compact package of a textile yarn according to claim 9, further comprising a turret which is capable of turning about a longitudinal axis thereof, said three containers being mounted on said turret.

11. An apparatus for producing a compact package of a textile yarn according to claim 1, wherein said accumulation container is provided with an inside cylindrical wall having an antislip configuration.

12. An apparatus for providing a compact package of a textile yarn according to claim 4, wherein said container being provided with a fluid separation chamber formed at an upper free end portion thereof, said fluid separation chamber is provided with a plurality of small apertures or slits formed on a wall of said chamber, whereby a fluid introduced into said separation chamber together with said yarn from said nozzle can escape from said separation chamber to the outside thereof by way of said apertures or slits.

13. An apparatus for producing a compact package of a textile yarn according to claim 12, further comprising a masking shield adjacently surrounding a part of an outside wall of said separation chamber where said compressing means is adjacently positioned in said separation chamber during a yarn package forming operation.

14. An apparatus for producing a compact package of a textile yarn according to claim 2, further comprising a mechanism for temporarily supplying said heating fluid into said container by way of said fluid supply apertures of said compression means during a period when said pressing head contacts a yarn block previously accumulated in said container.

15. An apparatus for producing a compact package of a textile yarn according to claim 9, further comprising a mechanism for heat setting a yarn package previously formed in a container, said heat set mechanism is disposed at said working position for said additional operation, said heat set mechanism comprises a pair of pneumatic compression means, each of said compression means is provided with a pressing head which is capable of being inserted into said container from the corresponding free end of said container when said container is positioned at said additional working position, each said pressing head is provided with a plurality of fluid supply apertures formed at a free end surface thereof, said apertures are connected to a fluid supply conduit.

16. An apparatus for producing a compact package of a textile yarn according to claim 15, further comprising a heated fluid supply conduit and a compressed air supply conduit and an oiling agent supply conduit, these three conduits being connected to said fluid supply conduit connected to one of said pressing heads, by way of control valve means, an oiling agent stock tank connected to said oiling agent supply conduit, a pump by which said oiling agent stock tank is connected to said fluid supply conduit being connected to the other one of said pressing heads.

* * * * *